US009460674B2

(12) United States Patent
Guo

(10) Patent No.: US 9,460,674 B2
(45) Date of Patent: Oct. 4, 2016

(54) DISPLAY PANEL AND DRIVING METHOD THEREOF, AND DISPLAY APPARATUS

(71) Applicant: BEIJING BOE OPTOELECTRONICS TECHNOLOGY CO., LTD., Beijing (CN)

(72) Inventor: Rui Guo, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 105 days.

(21) Appl. No.: 14/128,226

(22) PCT Filed: Dec. 6, 2012

(86) PCT No.: PCT/CN2012/086021

§ 371 (c)(1),
(2) Date: Dec. 20, 2013

(87) PCT Pub. No.: WO2014/000384

PCT Pub. Date: Jan. 3, 2014

(65) Prior Publication Data

US 2014/0125644 A1 May 8, 2014

(30) Foreign Application Priority Data

Jun. 26, 2012 (CN) ..... 2012 1 0214897

(51) Int. Cl.
*G09G 3/36* (2006.01)

(52) U.S. Cl.
CPC ..... *G09G 3/3648* (2013.01); *G09G 3/3607* (2013.01); *G09G 3/3614* (2013.01); *G09G 2300/0426* (2013.01); *G09G 2330/021* (2013.01)

(58) Field of Classification Search
CPC combination set(s) only.
See application file for complete search history.

(56) References Cited

U.S. PATENT DOCUMENTS

2008/0074369 A1* 3/2008 Hsu ..... G09G 3/3614 345/88
2009/0189881 A1* 7/2009 Ooishi et al. ..... 345/211
2009/0225103 A1* 9/2009 Shiomi ..... G02F 1/133514 345/690
2009/0316101 A1* 12/2009 Oh ..... G02F 1/136286 349/143

FOREIGN PATENT DOCUMENTS

CN 101494020 A 7/2009
CN 102750919 A 10/2012
WO 2011049106 A1 4/2011

OTHER PUBLICATIONS

International Preliminary Report on Patentability Appln. No. PCT/CN2012/08621; Dated Dec. 31, 2014.

(Continued)

*Primary Examiner* — Gerald Johnson
*Assistant Examiner* — Robert Michaud
(74) *Attorney, Agent, or Firm* — Ladas & Parry LLP

(57) ABSTRACT

A display panel, a driving method for the same, and a display apparatus, wherein the display panel includes: a display substrate with a plurality of TFTs arranged in an array, a source driving integrated circuit and a gate driving integrated circuit, the gate driving IC is connected with a plurality of gate lines, each gate line is connected with the gates of the TFTs in adjacent N rows, and different gate lines are connected with the gates of the TFTs in different rows, N is an integer being greater than 1; the source driving IC is connected with a plurality of source lines, sources of different TFTs connected to a same gate line are connected with different source lines, and sources of the TFTs, which are connected to different gate lines and located in a same column and spaced g*N−1 TFTs apart, are connected with a same source line.

11 Claims, 5 Drawing Sheets

(56) References Cited

OTHER PUBLICATIONS

Third Chinese Office Action Appln. No. 201210214897.9; Dated Sep. 3, 2014.
International Search Report Issued Mar. 25, 2013 Appln. No. PCT/CN2012/086021.
First Chinese Office Action Issued Sep. 3, 2013 Appln. No. 201210214897.9.
Second Chinese Office Action Issued Apr. 17, 2014 Appln. No. 201210214897.9.
Chinese Rejection Decision Appln. No. 201210214897.9; Dated Feb. 9, 2015.

* cited by examiner

DISPLAY PANEL AND DRIVING METHOD THEREOF, AND DISPLAY APPARATUS

TECHNICAL FIELD

Embodiments of the present disclosure relate to a field of semiconductor technique, and in particular to a display panel and a driving method thereof, and a display apparatus.

BACKGROUND

An architecture of a present liquid crystal display panel is shown in FIG. 1. A Liquid Crystal Display (LCD) comprises a display panel on which a plurality of Thin Film field effect Transistors (TFTs) are arranged, a Source Driving Integrated Circuit (Source Driver IC), having Source Lines, for driving sources of the TFTs, a Gate Driving Integrated Circuit (Gate Driver IC), having Gate Lines, for driving gates of the TFTs and a backlight module. One TFT correspond to one sub-pixel on the display panel. A plurality of sub-pixels are arranged in an array on the display panel and are referred to as a pixel array. Each of the thin film field effect transistors is connected with a capacitor. When a thin film field effect transistor is powered on, rotation degree of liquid crystal molecules is changed by means of rotation performance of the liquid crystal molecules filled in the thin film field effect transistor, so that the corresponding sub-pixel displays a corresponding color.

Under a control of a timing controller, the gate driving integrated circuit drives gates of the thin film field effect transistors connected with the gate lines to be turned on or off; when the gate of the thin film field effect transistor is turned on, the capacitor connected with the thin film field effect transistor starts to be charged, and the source driving integrated circuit drives the source line to output a corresponding driving signal.

According to an existing driving method, as illustrated in FIG. 2, each gate line in the gate driving integrated circuit is connected with the gates of the TFTs in one row, and each source line in the source driving integrated circuit is connected with the sources of the TFTs in one column. When a picture is displayed, the gates of the TFTs in one row are turned on at a time.

In order to reduce flickers so as to ensure a display quality of the picture, an inversion of pixels is performed by changing polarities of the driving signals output from the source lines, driven by the source driving integrated circuit, and in the pixel-inversion manner, a dot-inversion is best in the terms of picture quality, and the flickers therein is least.

An effect diagram of the dot-inversion is as illustrated in FIG. 3, a keypoint of this inversion manner is as follows: voltages on every two adjacent source lines have opposite polarities in a Yth frame of picture; a voltage on a same source line has opposite polarities in a (Y+1)th frame of picture and in the Yth frame of picture, and voltages on every two adjacent source lines have opposite polarities in the (Y+1)th frame of picture, wherein Y is an integer being greater than or equal to 1; thereby not only the aging of the liquid crystal may be avoided but also the power consumption may be reduced.

However, as illustrated in FIGS. 2 and 3, based on this structure, by using the dot-inversion manner, the polarity of the driving signal carried on each data line (source line) should be inverted once when the time for scanning one line elapses in a same picture, so that a large amount of power is consumed and the temperature at the source driving integrated circuit on the liquid crystal display panel is easily to rise. For example, in order to realize the dot-inversion effect, it is assumed that the polarity of the voltage of a red sub-pixel, located at $1^{st}$ row, $1^{st}$ column, is positive, then the corresponding polarity of the voltage of a red sub-pixel, located at $2^{nd}$ row, $1^{st}$ column, should be negative, and therefore the polarity on the first source line S1 would be changed from positive to negative when the gate driver starts to drive a second row of pixels from a first row of pixels.

SUMMARY

Embodiments of the present disclosure provide a display panel, a display apparatus and a driving method for the display panel.

The embodiments of the present disclosure provide a display panel, comprising a display substrate with a plurality of film thin transistors (TFTs) arranged in an array, a source driving integrated circuit for driving sources of the TFTs through source lines, and a gate driving integrated circuit for driving gates of the TFTs through gate lines, wherein, the gate driving integrated circuit is connected with a plurality of gate lines, each gate line is connected with the gates of the TFTs in adjacent N rows, and different gate lines are connected with the gates of the TFTs in the different rows, N is an integer, $1<N\leq$the total number of rows of the TFTs, and N is a multiple of 2;

the source driving integrated circuit is connected with a plurality of source lines, the sources of the different TFTs connected to a same gate line are connected with the different source lines, and the sources of the TFTs, which are connected to the different gate lines, located in a same column and spaced $g*N-1$ TFTs apart, are connected with a same source line, g is an integer, and $N\leq g*N\leq$the total number of rows of the TFTs.

The embodiments of the present disclosure further provide a display apparatus comprising the above display panel.

The embodiments of the present disclosure further provide a driving method for the above display panel, comprising:

driving, by a gate driving integrated circuit, respective gate lines one by one in a scan sequence, so as to drive the gates of TFTs in N rows connected with the gate line to be turned on simultaneously;

driving, by a source driving integrated circuit, respective source lines to output corresponding driving signals, when the gates of the TFTs in the N rows are turned on.

With the display panel, the display apparatus and the driving method for the display panel according to the embodiments of the present disclosure, following benefit effects may be achieved: the gates of TFTs in a plurality of rows are turned on simultaneously at a time, which may ensure turn-on time of the gate of each TFT; and one gate line is connected with the gates of the TFTs in the plurality of rows, so that a polarity inversion is not required to be performed frequently when an inversion of pixels is realized, and thus a power consumption may be reduced while a picture quality may be ensured.

DETAILED DESCRIPTION

Figure 1:
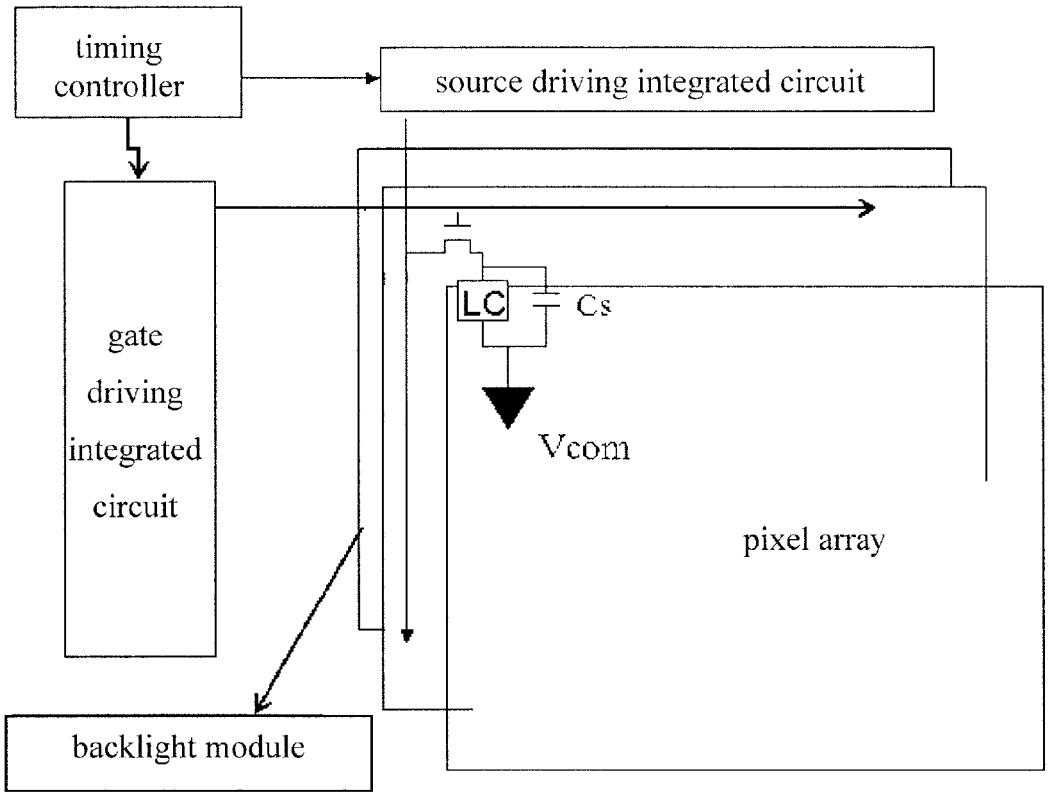
FIG. 1 is a structure diagram of an existing display panel.
Figure 2:
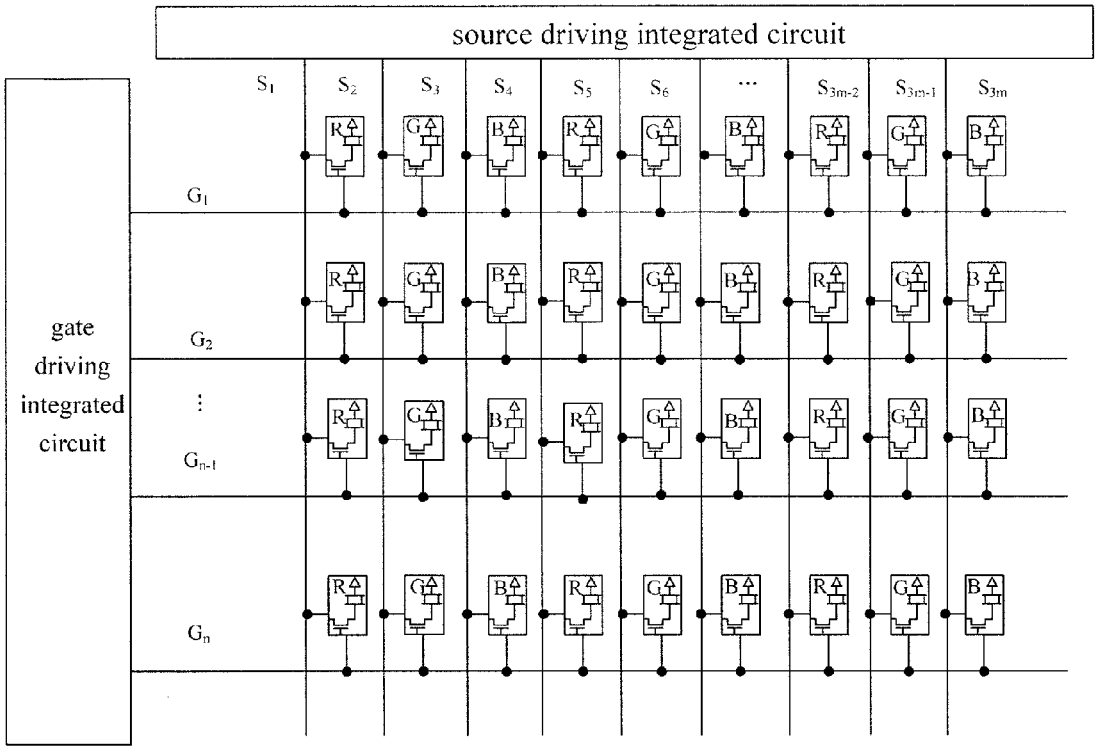
FIG. 2 is a schematic diagram illustrating an implementation for driving in the existing display panel.
Figure 3:
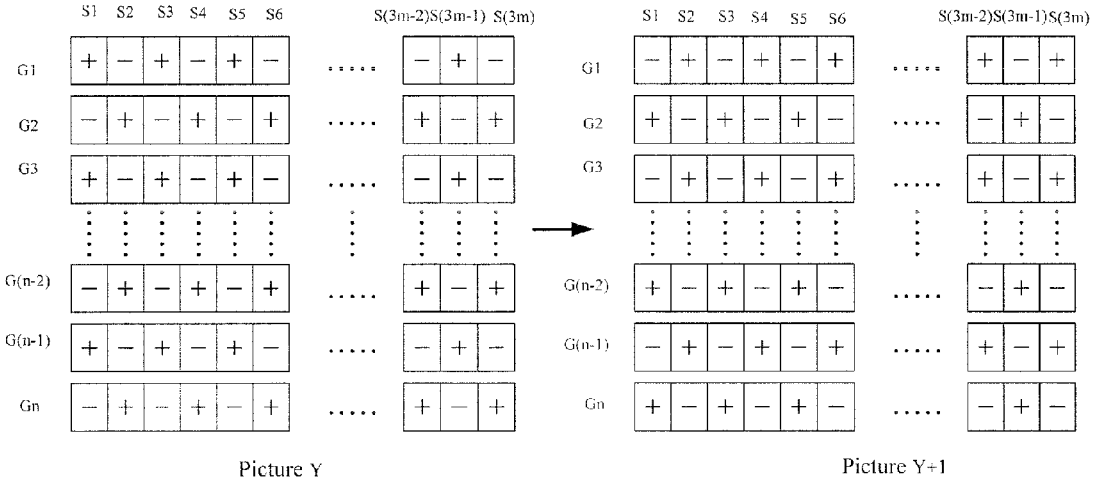
FIG. 3 is a schematic diagram illustrating polarities of driving signals output from the source lines for carrying out an inversion of pixels in the prior art.

The display panel and the driving method thereof provided in the embodiments of the present invention are further described in detail below in connection with drawings and embodiments.

The embodiments of the present disclosure provide a display panel, comprising a display substrate with a plurality of Film Thin Transistors (TFTs) arranged in an array, a source driving integrated circuit for driving sources of the TFTs through source lines, and a gate driving integrated circuit for driving gates of the TFTs through gate lines. On the display panel, one TFT corresponds to one sub-pixel, and the sub-pixel is a basic element constituting a pixel.

In this embodiment, the gate driving integrated circuit is connected with a plurality of gate lines, each gate line is connected with the gates of the TFTs in adjacent N rows, $1<N\leq$the total number of rows of the TFTs, and different gate lines are connected with the gates of the TFTs in the different rows, that is, the rows in which the TFTs connected to the respective gate lines are located do not overlap, and the gates of TFTs in each row are only connected with one gate line;

the source driving integrated circuit is connected with a plurality of source lines, the sources of the different TFTs connected to a same gate line are connected with the different source lines, respectively, and the source of the TFTs, which are connected to the different gate lines and located in a same column and spaced $g*N-1$ TFTs apart, are connected with a same source line, g is an integer, and $N<g*N\leq$the total number of rows of the TFTs.

Optionally, the gate driving integrated circuit drives the respective gate lines one by one in a scan sequence, so as to drive a plurality of rows (for example, N rows) of TFTs connected with one gate line to be turned on simultaneously since the one gate line is connected with the gates of TFTs in a plurality of rows; the source driving integrated circuit drives the respective source lines to output corresponding driving signals when the gates of the TFTs in the N rows are turned on, in order to realize an inversion of pixels.

In the embodiments of the present disclosure, a traditional driving manner in which only the gates of the TFTs corresponding to one row of sub-pixels are turned on at a time is changed, that is to say, the gates of the TFTs corresponding to the plurality of rows of sub-pixels are turned on simultaneously at a time, therefore turn-on time may be long, which ensures the turn-on time of the gates of each TFT, so that a display effect of a picture may be ensured. In the embodiments of the present disclosure, the number of the gate lines decrease to 1/N times as original since the gates of the TFTs corresponding to the plurality of sub-pixels are turned on simultaneously when one gate line is driven, thus the number of scanning also decreases to 1/N times as original. The polarity of the driving signal carried on each data line (source line) is inverted once every two frames, so that the power consumption may be reduced greatly and the temperature in the source driving integrated circuit on the liquid crystal display panel may not rise.

Optionally, driving the respective source lines to output the corresponding driving signals by the source driving integrated circuit drives comprises: for a same frame of picture, polarities of the driving signals output from the source lines connected with the sources of every two adjacent TFTs are opposite; and for every two adjacent frames of picture, the polarities of the driving signals output from the source line connected with the source of a same TFT are opposite, so that a dot-inversion effect may be achieved.

The embodiments of the present disclosure have no limitation on the type of the sub-pixels distributed on the display panel and the arrangement manner of the sub-pixels.

Figure 4:
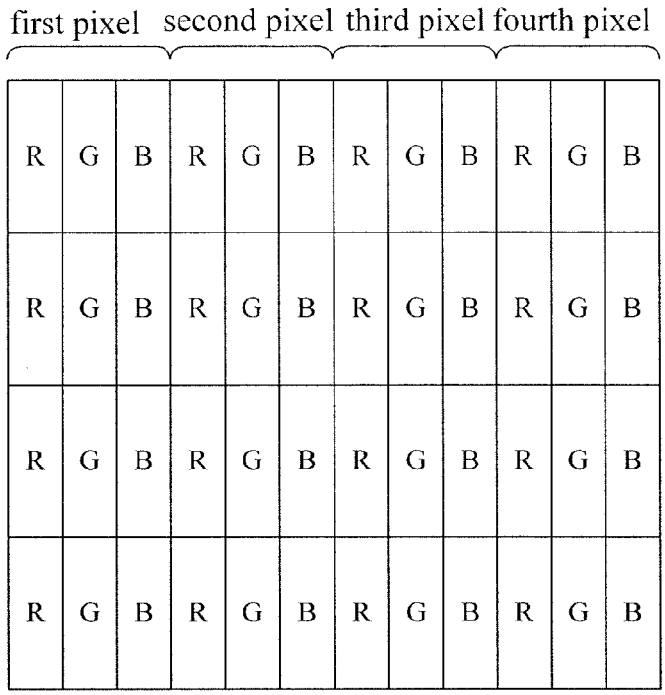
FIG. 4 is a schematic diagram illustrating a layout of an array of sub-pixels corresponding to TFTs on the existing display panel.

As illustrated in FIG. 4, in the prior art, each pixel comprises three sub-pixels of Red, Green, Blue (RGB). Each pixel on the liquid crystal panel comprises three sub-pixels of R, G, B, and light with any colors can be synthesized by means of the RGB sub-pixels after it passing liquid crystal molecules; thus the brighter three primary colors of R, G, B are, the wider color range can be represented is; on the contrary, the darker the three primary colors of R, G, B are, the narrower the color range can be represented is. Currently, the technology utilizing the three primary colors of R, G, B can not completely reproduce all colors perceptible by human eyes in the nature world since it fails to represent colors brighter than the three primary colors, and the traditional three primary colors have a deficiency on reproducibility of color representation for yellow and blue-green domains.

According to an embodiment of the present disclosure, four sub-pixels of Red, Green, Blue, White (RGBW) comprised in a pixel are arranged on the display panel, and the four sub-pixels in the respective pixels are arranged in a manner of a horizontal line or a rectangle; alternatively, four sub-pixels of Red, Green, Blue, Yellow (RGBY) comprised in a pixel are arranged on the display panel, and the four sub-pixels in the each pixel are arranged in a manner of a horizontal line or a rectangle. Of course, the sub-pixels with other colors may also be utilized to constituting each of the pixels and the number of the sub-pixels constituting each pixel is not limited to four, depending on actual requirements.

Optionally, in a case of being distributed in the horizontal line, the four sub-pixels of R, G, B, W are arranged sequentially in the manner of the horizontal line, and of course may also be arranged in other manners. Alternatively, the four sub-pixels of R, G, B, Y are arranged sequentially in the manner of the horizontal line, and of course may also be arranged in other manners.

Optionally, in a case of being distributed in the rectangle, the R, G sub-pixels in each pixel are arranged in a top edge of the rectangle sequentially, and the B, W sub-pixels are arranged in the bottom edge of the rectangle sequentially. Alternatively, the R, G sub-pixels in each pixel are arranged in the top edge of the rectangle sequentially, and the B, Y sub-pixels are arranged in the bottom edge of the rectangle sequentially.

The embodiments of the present disclosure change the situation of the traditional driving scheme in which only the gates of the TFTs in one row may be turned on at a time, ensure the time for charging a charging capacitor and the display effect, and also modify the arrangement manner of the pixels in the existing display panel by replacing the original RGB sub-pixels with the RGBW sub-pixels, wherein the RGB sub-pixels determine a color displayed by the pixel, and the W sub-pixel increases brightness displayed by the pixel; alternatively, by replacing the original RGB sub-pixels with the RGBY sub-pixels. Thus, a wider color gamut may be achieved.

Obviously, without departing from the principle of the embodiments of the present disclosure, the white sub-pixel or the yellow sub-pixel may also be replaced by other color sub-pixel in order to increase the reproducibility of corresponding color or to make a certain sub-pixel (or several sub-pixels) be bigger or smaller in order to increase or decrease the reproducibility of the corresponding color. The relative position arrangement of the RGBW sub-pixels or the RGBY sub-pixels may also be changed without departing from the principle of the embodiments of the present disclosure.

Also, in order to achieve an effect of progressive display of the pixels and make an integral pixel point is represented when the N rows of TFTs connected with each gate line are displayed, the number N of rows of TFTs connected with each gate line may be a multiple of 2 in this embodiments, for example. Optionally, N is a multiple of 4 when the four sub-pixels in each pixel are arranged in the manner of the horizontal line or the rectangle. Thus, it may ensure that an integral pixel point is displayed when the four sub-pixels in each pixel are arranged in the manner of the horizontal line or the rectangle. Further, N is optionally equal to 4 in this embodiment.

The embodiments of the present disclosure further provide a display apparatus comprising the above display panel provided in the above embodiments, and the detailed structure of the display panel is omitted herein.

The embodiments of the present disclosure further provide a driving method for the above display panel, comprising:

driving respective gate lines one by one in a scan sequence by a gate driving integrated circuit, so that gates of TFTs in N rows connected with the gate lines are turned on simultaneously; and driving respective source lines to output corresponding driving signals by a source driving integrated circuit, when the gates of the TFTs in the N rows are turned on.

Optionally, one TFT corresponds to one sub-pixel, and the source driving integrated circuit drives the respective source lines to output corresponding driving signals, so that the sub-pixels are inverted in manner of dot-inversion.

Optionally, driving the respective source lines to output corresponding driving signals by the source driving integrated circuit so that the sub-pixels are inverted in manner of dot-inversion particularly comprises:

for a same frame of picture, polarities of the driving signals output from the source lines connected with the sources of every two adjacent TFTs are opposite; and for every two adjacent frames of picture, the polarities of the driving signals output from the source line connected with the source of a same TFT are opposite.

Examples of the display panel according to the embodiments of the present disclosure will be described below by taking a case of four sub-pixels as an example.

First Embodiment

Figure 5:
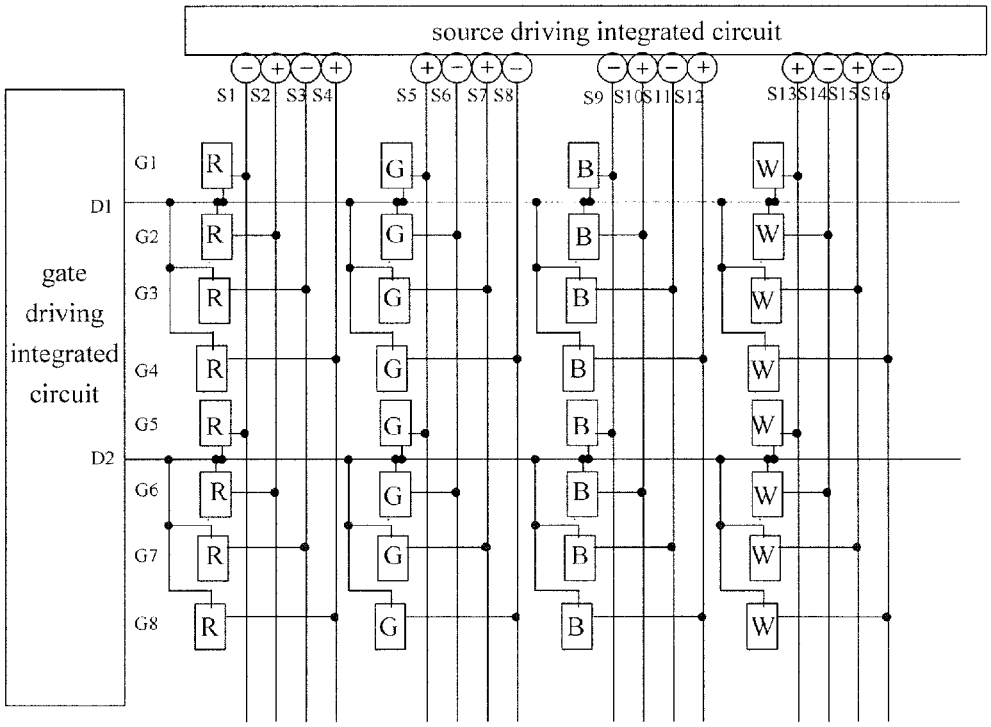
FIG. 5 is a schematic diagram illustrating a layout of an array of sub-pixels corresponding to TFTs on a display panel according to a first embodiment of the present disclosure.

In this embodiment, the display panel comprises a display substrate with a plurality of TFTs arranged in an array, a source driving integrated circuit, having source lines, for driving sources of the TFTs, a gate driving integrated circuit, having gate lines, for driving gates of the TFTs, and a backlight module. An exemplary arrangement diagram of the pixel array on the display panel is illustrated in FIG. 5, wherein each pixel comprises four sub-pixels of RGBW and the four sub-pixels of RGBW in each pixel are arranged in a manner of a horizontal line.

Each of the gate lines in the gate driving integrated circuit is connected with gates of TFTs in four adjacent rows, and the different gate lines are connected with the gates of TFTs in different rows; sources of the different TFTs connected with to a same gate line are connected with the different source lines, receptively, and the sources of the TFTs, which are connected to the different gate lines, located in a same column and spaced g*4−1 TFTs apart, are connected with a same source line, g is a positive integer. For example, the TFT, which is connected with a first gate line D1 and located at $1^{st}$ row, $1^{st}$ column, and the TFT, which is connected with a second gate line D2 and located at $5^{th}$ row, $1^{st}$ column, are connected with S1; the TFT, which is connected with the first gate line D1 and located at $2^{nd}$ row, the $1^{st}$ column, and the TFT, which is connected with the second gate line D2 and located at $6^{th}$ row, $1^{st}$ column, are connected with S2; the TFT, which is connected with the first gate line D1 and located at $3^{rd}$ row, the $1^{st}$ column, and the TFT, which is connected with the second gate line D2 and located at $7^{th}$ row, $1^{st}$ column, are connected with S3; the TFT, which is connected with the first gate line D1 and located at $4^{th}$ row, the $1^{st}$ column, and the TFT, which is connected with the second gate line D2 and located at $8^{th}$ row, $1^{st}$ column, are connected with S4; and so on.

As driving, the gate driving integrated circuit drives the respective gate lines one by one in a scan sequence, so that the gates of four rows of TFTs connected with one gate line are turned on simultaneously, and the source driving integrated circuit drives the respective source lines to output corresponding driving signals when the gates of the four rows of TFTs are turned on, in order to realize an inversion of pixels.

In particular, when the gate driving integrated circuit drives the gate line D1, the TFTs numbered as G1, G2, G3, G4 in the pixel array may be turned on simultaneously while the source driving integrated circuit outputs corresponding pixel data; and when the gate driving integrated circuit drives the gate line D1 to be turned on, the TFTs numbered as G[4(i−1)+1], G[4(i−1)+2], G[4(i−1)+3], G[4(i−1)+4] in the pixel array may be turned on simultaneously, $1 \leq i \leq$an integer obtained by diving the total number of rows of TFTs by 4.

Figure 6:
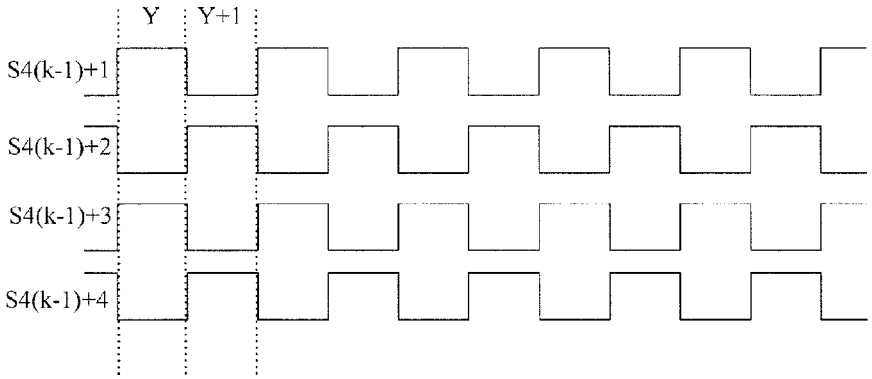
FIG. 6 is a diagram of polarity signals of driving signals output from source lines for carrying out an inversion of pixels, according to the first embodiment of the present disclosure.
Figure 7:
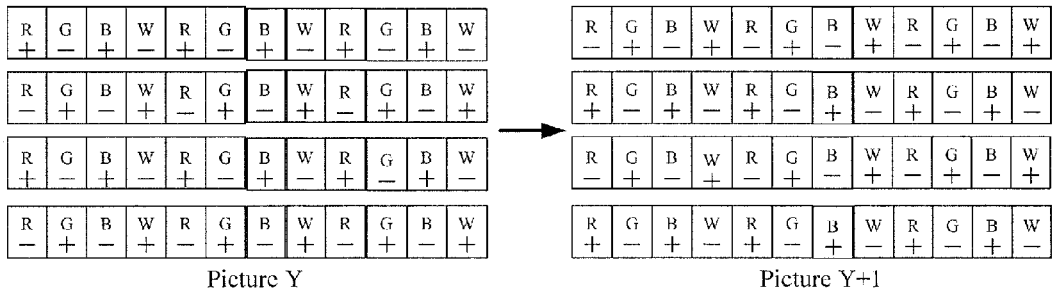
FIG. 7 is a schematic diagram of polarities of driving signals output from source lines for carrying out an inversion of pixels, according to the first embodiment of the present disclosure.

A manner in which the source driving integrated circuit drives the respective source lines to output corresponding driving signals so as to realize the pixel inversion is illustrated in FIGS. 6 and 7. A principle of this inversion manner is: for a same frame of picture, polarities of the driving signals output from the source lines connected with every two adjacent TFTs are opposite; and for every two adjacent frames of picture, the polarities of the driving signals output from the source line connected with a same TFT are opposite.

Referring to the pixel array illustrated in FIG. 5, in particular, for a Yth frame of picture, polarities of voltages of the driving signal output from a same source line in the source driving integrated circuit are same, the polarities of the driving signals from every two adjacent source lines among the (4(k−1)+1)th, (4(k−1)+2)th, (4(k−1)+3)th, (4(k−1)+4)th source lines are opposite, 1≤k≤an integer obtained by diving the total number of the source lines by 4; for a (Y+1)th frame of picture, the polarity of the voltage of the driving signal output from a same source line in the source driving integrated circuit is opposite to that from the same source line in the Yth frame, the polarities of the driving signals from every two adjacent source lines among the (4(k−1)+1)th, (4(k−1)+2)th, (4(k−1)+3)th, (4(k−1)+4)th source lines are opposite, wherein Y is an integer being greater than or equal to 1. Thus, not only an ageing of the liquid crystal may be avoided but also the power consumption may be reduced.

Second Embodiment

In this embodiment, no changes are made except the white sub-pixel is replaced by a yellow sub-pixel as compared with First embodiment, so that insufficient color reproducibility of the yellow and blue-green may be compensated. Further, some colors which are difficult to be represented by the technique with the traditional three primary colors, such as the yellow, the golden, the blue-green, etc, may be reproduced more vividly, a representation color gamut of the blue is extended, the color reproducibility of the blue, the green and the yellow is enhanced, so that a wavelength of the yellow may be used effectively and a wider color gamut may be achieved.

Third Embodiment

Figure 8:
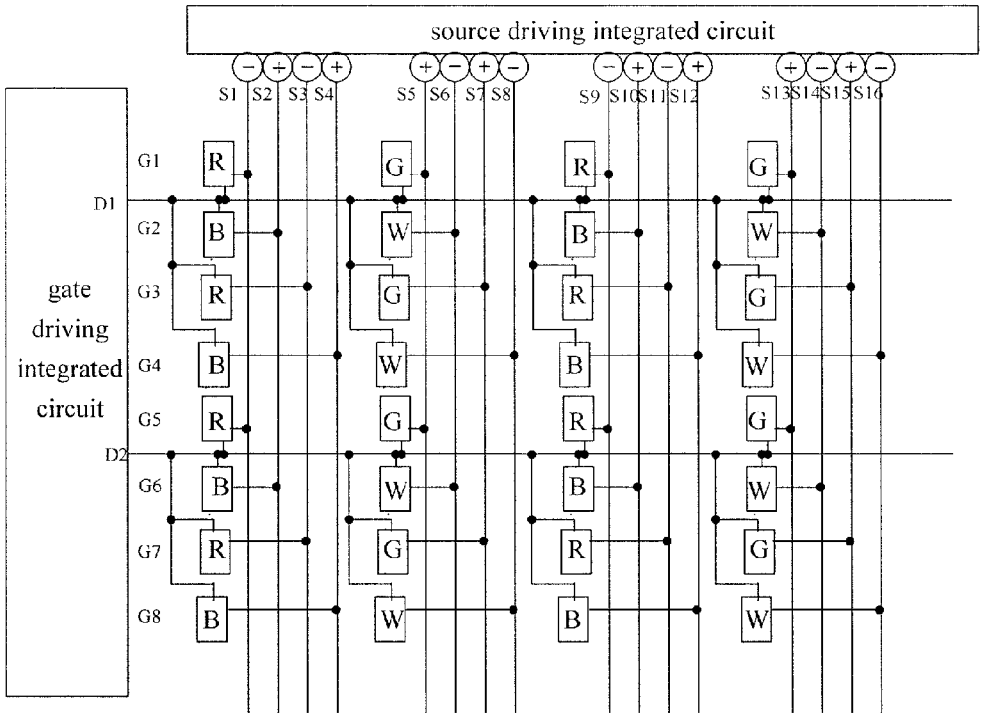
FIG. 8 is a schematic diagram illustrating a layout of an array of sub-pixels corresponding to TFTs on a display panel according to a third embodiment of the present disclosure.

In this embodiment, the display panel comprises a display substrate with a plurality of TFTs arranged in an array, a source driving integrated circuit, having source lines, for driving sources of the TFTs, a gate driving integrated circuit, having gate lines, for driving gates of the TFTs, and a backlight module. An exemplary arrangement diagram of the pixel array on the display panel is illustrated in FIG. 8, wherein each pixel comprises four sub-pixels of RGBW and the four sub-pixels of RGBW in each pixel are arrange in a manner of a rectangle.

Each of the gate lines in the gate driving integrated circuit is connected with gates of TFTs in four adjacent rows, and the different gate lines are connected with the gates of TFTs in different rows; sources of the different TFTs connected with to a same gate line are connected with the different source lines, receptively, and the sources of the TFTs, which are connected to the different gate lines, located in a same column and spaced g*4−1 TFTs apart, are connected with a same source line, g is a positive integer. For example, the TFT, which is connected with a first gate line D1 and located at $1^{st}$ row, $1^{st}$ column, and the TFT, which is connected with a second gate line D2 and located at $5^{th}$ row, $1^{st}$ column, are connected with S1; the TFT, which is connected with the first gate line D1 and located at $2^{nd}$ row, the $1^{st}$ column, and the TFT, which is connected with the second gate line D2 and located at $6^{th}$ row, $1^{st}$ column, are connected with S2; the TFT, which is connected with the first gate line D1 and located at $3^{rd}$ row, the $1^{st}$ column, and the TFT, which is connected with the second gate line D2 and located at $7^{th}$ row, $1^{st}$ column, are connected with S3; the TFT, which is connected with the first gate line D1 and located at $4^{th}$ row, the $1^{st}$ column, and the TFT, which is connected with the second gate line D2 and located at $8^{th}$ row, $1^{st}$ column, are connected with S4; and so on.

As driving, the gate driving integrated circuit drives the respective gate lines one by one in a scan sequence, so as to simultaneously drive the gates of the four rows of TFTs connected with one gate line to be turned on, and the source driving integrated circuit drives the respective source lines to output corresponding driving signals when the gates of the TFTs in the four rows are turned on, in order to realize an inversion of pixels.

In particular, when the gate driving integrated circuit drives the gate line D1, the TFTs numbered as G1, G2, G3, G4 in the pixel array may be turned on simultaneously while the source driving integrated circuit outputs corresponding pixel data; and when the gate driving integrated circuit drives the gate line D1 to be turned on, the TFTs numbered as G[4(i−1)+1], G[4(i−1)+2], G[4(i−1)+3], G[4(i−1)+4] in the pixel array may be turned on simultaneously, 1≤i≤an integer obtained by diving the total number of rows of TFTs by 4.

Figure 9:
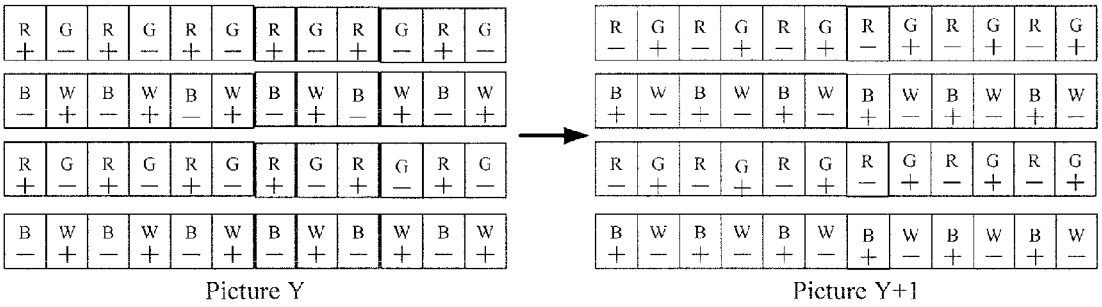
FIG. 9 is a schematic diagram of polarities of the driving signals output from source lines for carrying out an inversion of pixels, according to the third embodiment of the present disclosure.

A manner in which the source driving integrated circuit drives the respective source lines to output corresponding driving signals so as to realize the pixel inversion is illustrated in FIG. 9. A principle of this inversion manner is: for a same frame of picture, polarities of the driving signals output from the source lines connected with every two adjacent TFTs are opposite; and for every two adjacent frames of picture, the polarities of the driving signals output from the source line connected with a same TFT are opposite.

Referring to the pixel array illustrated in FIG. 8, in particular, for a Yth frame of picture, polarities of voltages of the driving signal output from a same source line in the source driving integrated circuit are same, the polarities of the driving signals from every two adjacent source lines among the (4(k−1)+1)th, (4(k−1)+2)th, (4(k−1)+3)th, (4(k−1)+4)th source lines are opposite, 1≤k≤an integer obtained by diving the total number of the source lines by 4; for a (Y+1)th frame of picture, the polarity of the voltage of the driving signal output from a same source line in the source driving integrated circuit is opposite to that from the same source line in the Yth frame, the polarities of the driving signals from every two adjacent source lines among the (4(k−1)+1)th, (4(k−1)+2)th, (4(k−1)+3)th, (4(k−1)+4)th source lines are opposite, wherein Y is an integer being greater than or equal to 1. Thus not only an ageing of the liquid crystal may be avoided but also the power consumption may be reduced.

Difference between this embodiment and the First embodiment is in that the arrangement manners of the sub-pixels corresponding to the TFTs are different. For a display panel with a resolution of m*n (m represents the total number of columns, n represents the total number of rows), the number of data lines required for the gate driving integrated circuit is n/4 and the number of data lines required for the source driving integrated circuit is 16 m in the First embodiment, while the number of data lines required for the gate driving integrated circuit is n/2 and the number of data lines required for the source driving integrated circuit is 8 m in this embodiment.

Fourth Embodiment

In this embodiment, no changes are made except the white sub-pixel is replaced by a yellow sub-pixel as compared with Third embodiment, so that insufficient color reproducibility of the yellow and blue-green may be compensated. Further, some colors which are difficult to be represented by the technique with the traditional three primary colors, such as the yellow, the golden, the blue, etc, may be reproduced more vividly, a representation color gamut of the blue is extended, the color reproducibility of the blue, the green and the yellow is enhanced, so that a wavelength of yellow may be used effectively and a wider color gamut may be achieved.

In the above embodiments of the present disclosure, a plurality of gates of rows of TFTs are turned on simultaneously at a time, which may ensure the turn-on time of the gates of each TFT. With respect to a liquid crystal screen with the traditional three primary colors, which has a same resolution, the number of the data lines is increased, but the number of the gate scan lines is decreased to ¼ or ½ times as original, which may ensure the turn-on time of the gates and improve a picture quality effectively. Also, the added pixels may be used for improving utilization of the backlight and reducing the power consumption or extending the color gamut. An inversion manner utilizes a column-inversion at the side of source driving integrated circuit, in order to achieve the effect of a dot-inversion of pixels at the side of the panel, so that the power consumption is reduced while the picture quality is ensured.

Obviously, those of skill in the art can implement various modifications and variations to the embodiments of the present disclosure without departing from the spirit and principle of the present disclosure. Thereby, the present disclosure is intended to include these modifications and variations if such modifications and variations to the embodiments of the present disclosure are within the scope of the claims of the present disclosure and equivalents thereof.

What is claimed is:

1. A display panel, comprising a display substrate with a plurality of film thin transistors TFTs arranged in an array, a source driving integrated circuit for driving sources of the TFTs through source lines, and a gate driving integrated circuit for driving gates of the TFTs through gate lines, wherein, the gate driving integrated circuit is connected with a plurality of gate lines, each gate line is connected with the gates of the TFTs in adjacent N rows so as to turn on the TFTs in the adjacent N rows simultaneously, and different gate lines are connected with the gates of the TFTs in different rows, N is a multiple of 4, $1<N<$the total number of rows of the TFTs;

the source driving integrated circuit is connected with a plurality of source lines, the sources of different TFTs connected to a same gate line are connected with different source lines, and the sources of the TFTs, which are connected to different gate lines and located in a same column and spaced $g*N-1$ TFTs apart, are connected with a same source line, g is an integer;

wherein the display panel comprises a plurality of pixels arranged in an array; each pixel comprises four sub-pixels corresponding to different color components respectively, each sub-pixel being controlled by one TFT, and the four sub-pixels are arranged in a manner of a horizontal line or a rectangle, and the source driving integrated circuit drives the sub-pixels in a dot-inversion.

2. The display panel of claim 1, wherein the four sub-pixels are red, green, blue and white sub-pixels, or red, green, blue and yellow sub-pixels.

3. The display panel of claim 1, wherein the gate driving integrated circuit drives the respective gate lines one by one in a scan sequence, so as to drive the gates of TFTs in the N rows connected with a gate line to be turned on simultaneously;

the source driving integrated circuit drives the respective source lines to output corresponding driving signals when the gates of the TFTs in the N rows are turned on.

4. The display panel of claim 3, wherein driving the respective source lines, by the source driving integrated circuit, to output the corresponding driving signals comprises:

for a same frame of picture, polarities of the driving signals output from the source lines connected with the sources of every two adjacent TFTs are opposite; and for every two adjacent frames of picture, the polarities of the driving signals output from the source line connected with the source of a same TFT are opposite.

5. A display apparatus comprising the display panel of claim 1.

6. The display apparatus of claim 5, wherein the four sub-pixels are red, green, blue and white sub-pixels, or red, green, blue and yellow sub-pixels.

7. The display apparatus of claim 5, wherein the gate driving integrated circuit drives the respective gate lines one by one in a scan sequence, so as to drive the gates of TFTs in the N rows connected with a gate line to be turned on simultaneously;

the source driving integrated circuit drives the respective source lines to output corresponding driving signals when the gates of the TFTs in the N rows are turned on.

8. The display apparatus of claim 7, wherein driving the respective source lines, by the source driving integrated circuit, to output the corresponding driving signals comprises:

for a same frame of picture, polarities of the driving signals output from the source lines connected with the sources of every two adjacent TFTs are opposite; and for every two adjacent frames of picture, the polarities of the driving signals output from the source line connected with the source of a same TFT are opposite.

9. A driving method for the display panel of claim 1, comprising:

driving, by a gate driving integrated circuit, respective gate lines one by one in a scan sequence, so as to drive the gates of TFTs in the N rows connected with a gate line to be turned on simultaneously;

driving, by a source driving integrated circuit, respective source lines to output corresponding driving signals, when the gates of the TFTs in the N rows are turned on.

10. The driving method of claim 9, wherein one TFT corresponds to one sub-pixel, and the source driving integrated circuit drives the respective source lines to output corresponding driving signals, so that the sub-pixels represent an inversion manner of dot-inversion.

11. The driving method of claim 10, wherein driving the respective source lines, by the source driving integrated circuit, to output the corresponding driving signals comprises:

for a same frame of picture, polarities of the driving signals output from the source lines connected with the sources of every two adjacent TFTs are opposite; and for every two adjacent frames of picture, the polarities of the driving signals output from the source line connected with the source of a same TFT are opposite.

* * * * *